US005098252A

United States Patent [19]

Sheesley et al.

[11] Patent Number: 5,098,252

[45] Date of Patent: Mar. 24, 1992

[54] SKID STEER LOADER ADAPTOR

[75] Inventors: Donald L. Sheesley, New Holland; Edgar M. Payne, Bowmansville; John L. Lee, Reamstown, all of Pa.

[73] Assignee: Ford New Holland, Inc., New Holland, Pa.

[21] Appl. No.: 650,106

[22] Filed: Feb. 4, 1991

[51] Int. Cl.[5] ..... E02F 9/00

[52] U.S. Cl. ..... 414/723; 172/273; 403/324; 403/325

[58] Field of Search ..... 414/723; 172/271-273; 403/322, 324, 325

[56] References Cited

U.S. PATENT DOCUMENTS 3,794,195 2/1974 Clevenger et al. ..... 414/723

4,850,789 7/1989 Zimmerman ..... 172/272 X

*Primary Examiner*—David A. Bucci

*Assistant Examiner*—Donald W. Underwood

*Attorney, Agent, or Firm*—Larry W. Miller; Frank A. Seemar; Darrell F. Marquette

[57] ABSTRACT

An adaptor mechanism for use with a skid steer loader having an implement mounting plate configured in a first attachment configuration is disclosed wherein the adaptor mechanism permits the attachment of an implement configured in a second implement attachment configuration to the skid steer loader. The adaptor mechanism includes a movable locking mechanism having hook members protruding perpendicularly therefrom for engagement with the overcenter wedging mechanism in the implement mounting apparatus on the skid steer loader. A spring biases a locking mechanism toward a retracted position; however, engagement of the hook members by the skid steer loader overcenter wedging mechanism overcomes the biasing force exerted by the spring to force the locking mechanism into engagement with the implement being mounted thereto.

20 Claims, 7 Drawing Sheets

10
11
12
15
16
17
18
19
G
2a
1a

SKID STEER LOADER ADAPTOR

BACKGROUND OF THE INVENTION

The present invention relates generally to skid steer loaders having an implement mounting mechanism adaptable for selectively mounting a variety of implements thereto and, more particularly, to an adaptor mechanism for use with the skid steer loader implement mounting mechanism to permit an implement of a different attachment configuration to be mounted to the skid steer loader and used therewith.

Skid steer loaders are typically provided with a unitized frame having fixed wheels mobilely supporting the frame over the ground. The wheels are driven hydraulically in a manner that differential power can be applied to the wheels on the opposing sides of the loader to effect a steering thereof in a skidding manner somewhat like a tank. Skid steer loaders have a centrally located operator compartment and boom arms pivotally mounted to the frame and extending forwardly of the loader to carry an implement mounting mechanism which is engageable with detachable implements positionable within the view of the operator to permit a variety of uses of the skid steer loader. These implement mounting mechanisms utilize a quick-attach apparatus to facilitate the mounting of an implement thereto.

Skid steer loaders built by one manufacturer will normally utilize a different quick-attach apparatus configuration than each of the competitive companies. As a result, implements are typically not interchangeable between skid steer loaders of one manufacturer and those of another. Since implements do not necessarily require replacement at the same frequency which the skid steer loader requires replacement, an operator may be financially restrained from purchasing either the implements or the skid steer loader from more than one particular manufacturer to remain consistent in the mounting mechanisms being utilized This problem could be alleviated if an adaptor mechanism were provided to permit the implements manufactured by one manufacturer to be mounted to the skid steer loader of a different manufacturer, even though the manufacturers are utilizing different attachment configurations.

SUMMARY OF THE INVENTION

It is an object of this invention to overcome the aforementioned disadvantages of the prior art by providing an adaptor mechanism for use with skid steer loaders to permit the attachment of implements thereto even though utilizing a different attachment configuration.

It is another object of this invention to provide an adaptor mechanism that can be mounted on the skid steer loader of one manufacturer to permit the selective attachment of implements of a second manufacturer.

It is an advantage of this invention that an operator of a skid steer loader can have greater flexibility in the selection of implements to be mounted on the skid steer loader for use therewith.

It is a feature of this invention that the adaptor mechanism incorporates the attachment configuration of both the skid steer loader and the implements to be attached thereto.

It is another advantage of this invention that the implements utilizing one attachment configuration can be mounted on a skid steer loader utilizing a second attachment configuration.

It is another feature of this invention that the overcenter wedging mechanism associated with the skid steer loader of one manufacturer can be utilized in the same manner to attach implements thereto irrespective of the manufacturer of the implement.

It is still another feature of this invention that the adaptor mechanism utilizes a locking mechanism movable between a retracted position and an engaging position.

It is still another advantage of this invention that the engagement of hook members on the adaptor mechanism by the skid steer loader overcenter wedging mechanism forces locking pins into engagement with an implement to effect a mounting thereof to the adaptor mechanism.

It is yet another feature of this invention that the adaptor mechanism incorporates a spring biasing the locking mechanism into a retracted position.

It is yet another advantage of this invention that the mounting of the adaptor mechanism to the implement mounting apparatus of the skid steer loader causes a partial deflection of the biasing spring to urge hook members into engagement with the implement mounting apparatus to retain the adaptor mechanism on the skid steer loader.

It is still another object of this invention to provide an adaptor mechanism utilizing first and second attachment configurations interengaged with one another to permit the manipulation of the attachment configuration associated with the skid steer loader to effect a mounting of an implement utilizing a different attachment configuration.

It is a further object of this invention to provide an adaptor mechanism for use with a skid steer loader which is durable in construction, inexpensive of manufacture, carefree of maintenance, facile in assemblage, and simple and effective in use.

These and other objects, features and advantages are accomplished according to the instant invention by providing an adaptor mechanism for use with a skid steer loader having an implement mounting plate configured in a first attachment configuration, wherein the adaptor mechanism permits the attachment of an implement configured in a second implement attachment configuration to the skid steer loader. The adaptor mechanism includes a movable locking mechanism having hook members protruding perpendicularly therefrom for engagement with the overcenter wedging mechanism in the implement mounting apparatus on the skid steer loader. A spring biases a locking mechanism toward a retracted position; however, engagement of the hook members by the skid steer loader overcenter wedging mechanism overcomes the biasing force exerted by the spring to force the locking mechanism into engagement with the implement being mounted thereto.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figures 1A, 1B, 2A, 2B:
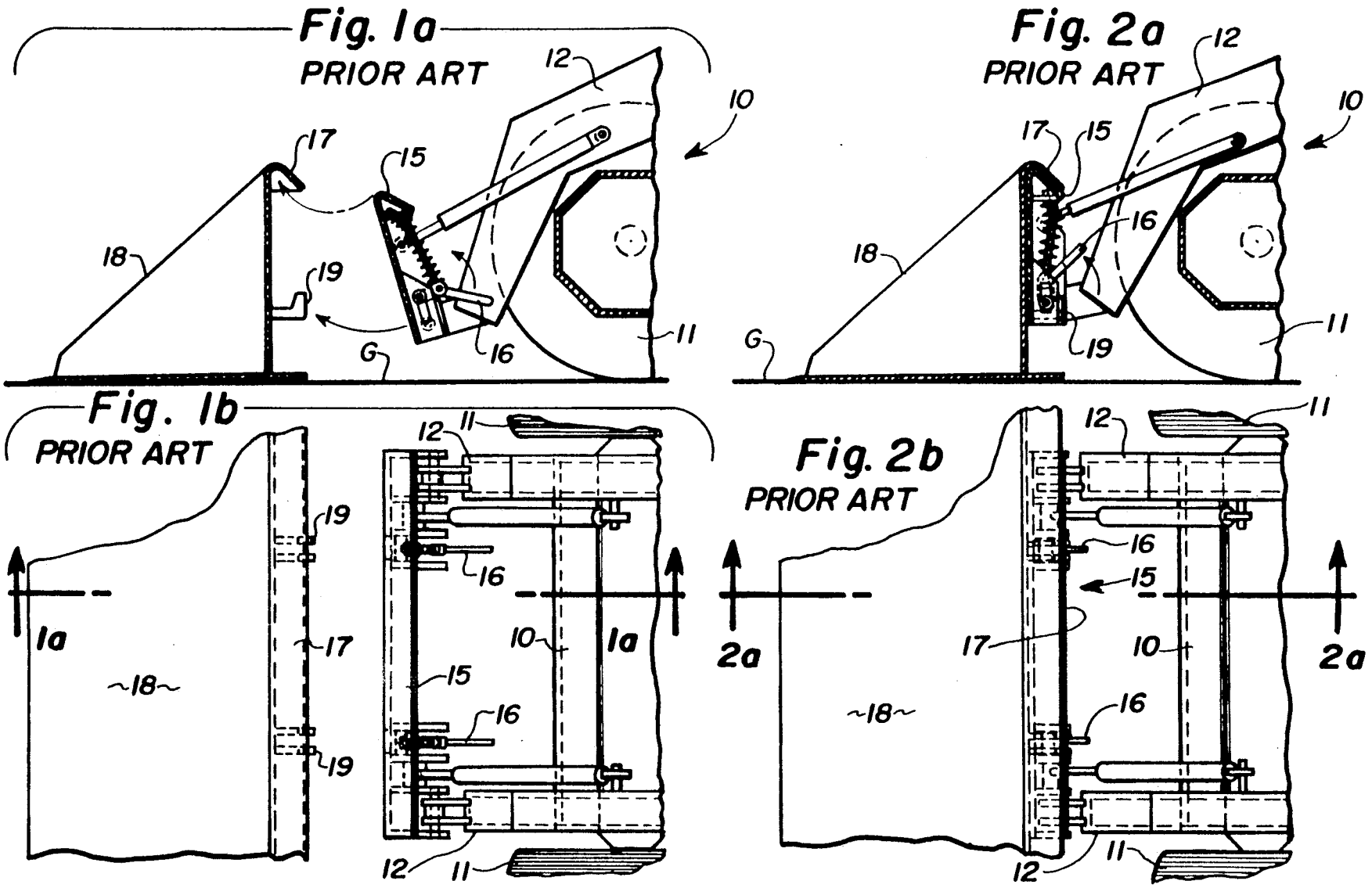
Fig. 2a PRIOR ART
Fig. 2b PRIOR ART
Fig. 1a PRIOR ART
Fig. 1b PRIOR ART
FIG. 1*a* is a partial cross-sectional view of a skid steer loader taken along lines 1*a*–1*a* of FIG. 1*b* to depict a partial side elevational view of a skid steer loader of known construction approaching an implement having the same attachment configuration to effect the mounting thereof on the skid steer loader.
FIG. 1*b* is a partial top plan view of the skid steer loader and implement shown in FIG. 1*a;*
FIG. 2*a* is a partial cross-sectional view of a skid steer loader taken along lines 2*a*-2*a* of FIG. 2*b* to depict a partial side elevational view of the skid steer loader corresponding to that of FIG. 1*a* with the detachable implement being mounted thereon.
FIG. 2*b* is a partial top plan view of the skid steer loader and mounted implement shown in FIG. 2*a;*

Referring now to the drawings and, particularly, to FIGS. 1 and 2 the known mounting of an implement to the implement mounting apparatus of a skid steer loader can best be seen. The skid steer loader 10 includes hydraulically driven wheels 11 mobilely supporting the skid steer loader 10 over the ground G and forwardly extending, pivoted boom arms 12 carrying at the forward ends thereof an implement mounting apparatus 15 engageable with an implement 18 to effect a mounting thereof on the skid steer loader 10.

It can be seen that both the implement mounting apparatus 15 and the implement 18 utilize identical attachment configurations in the form of a pair of rearwardly directed hook members 19 insertable through the implement mounting apparatus 15 to be engageable with an overcenter wedging mechanism 16 to detachably affix the implement 18 on the skid steer loader 10, the implement mounting apparatus !5 being wedged underneath an angled support member 17 forming a part of the implement 18. The implement mounting apparatus 15 and operation of the overcenter wedging mechanism 16 are described in greater detail in U.S. Pat. No. 3,794,195 issued to J. T. Clevenger et al on Feb. 26, 1984, the descriptive portions of which are incorporated herein by reference.

Figure 3A:
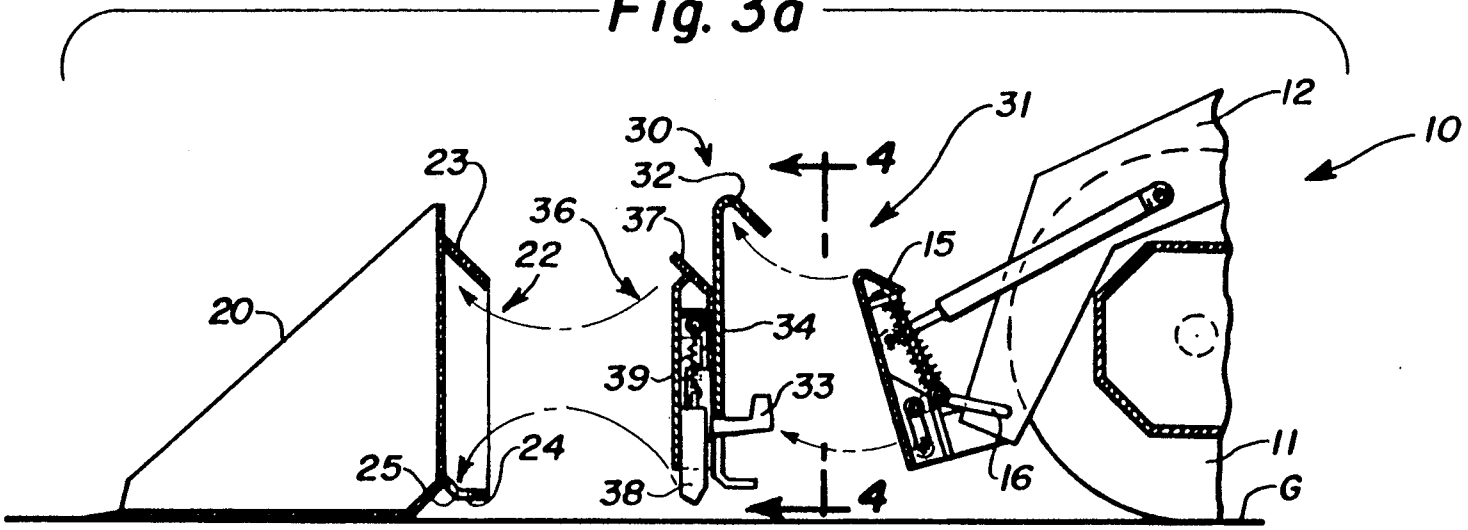
FIG. 3*a* is a partial cross-sectional view corresponding to that of FIG. 1*a* and schematically depicting a side elevational view of the adaptor mechanism to permit the mounting of an implement utilizing a different attachment configuration on the skid steer loader.
Figure 3B:
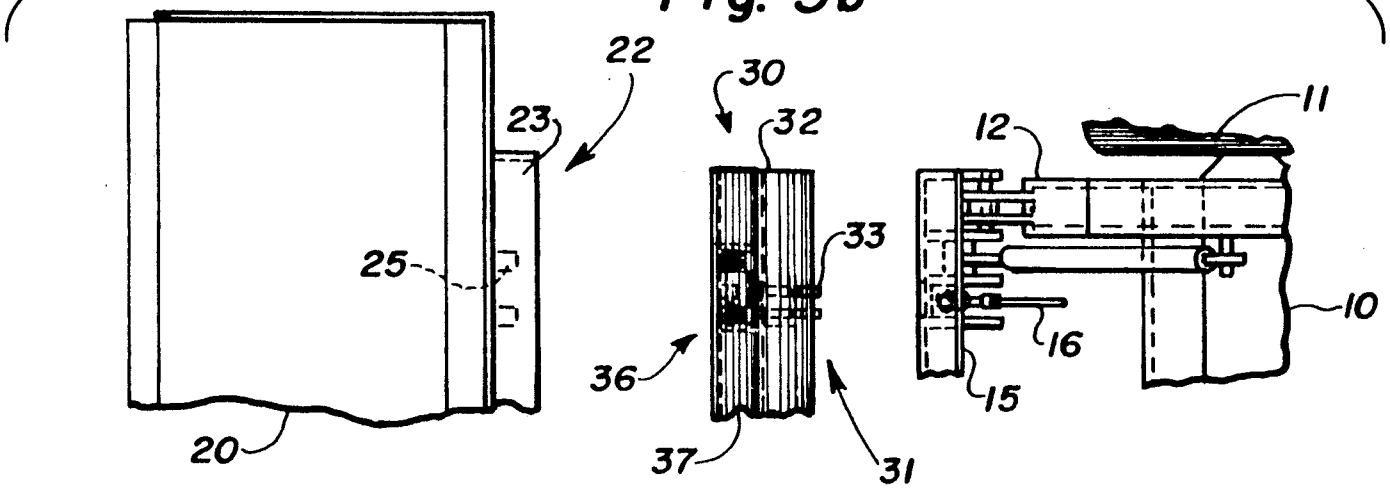
FIG. 3*b* is a partial top plan view of the skid steer loader, implement, and adaptor mechanism shown in FIG. 3*a;*

Referring now to FIGS. 3*a* and 3*b*, it can be seen that the implement 20, exemplarily shown in the form of a bucket, is provided with an attachment mechanism 22 having a different configuration than the implement 18 shown in FIGS. 1 and 2. More specifically, the attachment mechanism 22 includes a outwardly sloping member 23, which generally corresponds to the angled support member 17 of the implement 18; however, instead of hook members 19, as seen in FIGS. 1 and 2, the attachment mechanism 22 utilizes rearwardly extending brackets 24 having a generally vertical hole 25 formed therein for engagement with a locking pin (not shown) to fix the implement 20 on its corresponding loader.

One skilled in the art will readily realize that the implement mounting apparatus !5 described above with respect to FIGS. 1 and 2 and shown in FIG. 3 does not incorporate a downwardly moving locking pin to permit the implement 20 to be mounted thereon for operative use. Accordingly, the operator of the loader 10 having an implement mounting apparatus 15 of the configurations shown in FIGS. 1, 2, and 3, would not be able to use the implement 20 without the provision of an adaptor 30 disposed therebetween.

Referring now to FIGS. 3-6, the general structural features of the adaptor mechanism can best be seen. The adaptor 30 shown in FIGS. 3-11 is described herein as being configured to permit the mounting of an implement 20 having an attachment mechanism 22 on the loader 10 provided with an implement mounting apparatus 15 of the configuration utilizing hook members 19 as described above. However, one skilled in the art will readily realize that other adaptor configurations can be provided within the principles and scope of the invention to mount implements having still further attachment configurations on a loader having yet a different attachment mounting apparatus.

The adaptor 30 has a first attachment mechanism 31 configured to be mounted on the implement mounting apparatus 15 on the loader 10. The attachment mechanism 31 includes a downwardly extending angled support member 32 positioned to fit over top of the implement mounting apparatus 15 and a pair of rearwardly extending hook members 33 engageable with the overcenter wedging mechanism 16 when inserted into the implement mounting apparatus 15. The adaptor 30 also includes a second attachment mechanism 36 having an upwardly extending sloped member 37 positionable underneath the angled member 23 on the implement 20 and a pair of generally vertically movable locking pins 38 insertable through the holes 25 in the rearwardly extending bracket for the implement 20.

As best seen in FIGS. 3-6, the adaptor 30 presents an attachment mechanism 31 to the implement mounting apparatus 15 that approximates a normal engagement with a similarly configured implement 18, as shown in FIGS. 1 and 2. Accordingly, the first attachment mechanism 31 is provided with a first faceplate 34 extending downwardly from the angled support member 32 spanning the gap between the transversely spaced hook members 33. Likewise, the second attachment mechanism 36 approximates the normal implement mounting apparatus typically used in conjunction with the attachment of the implement 20 and includes a pair of second faceplates 39 corresponding to the transversely spaced locking pins 38 to engage the implement 20 and properly position the locking pins 38 for insertion through the holes 25 and bracket 24.

Figure 4:
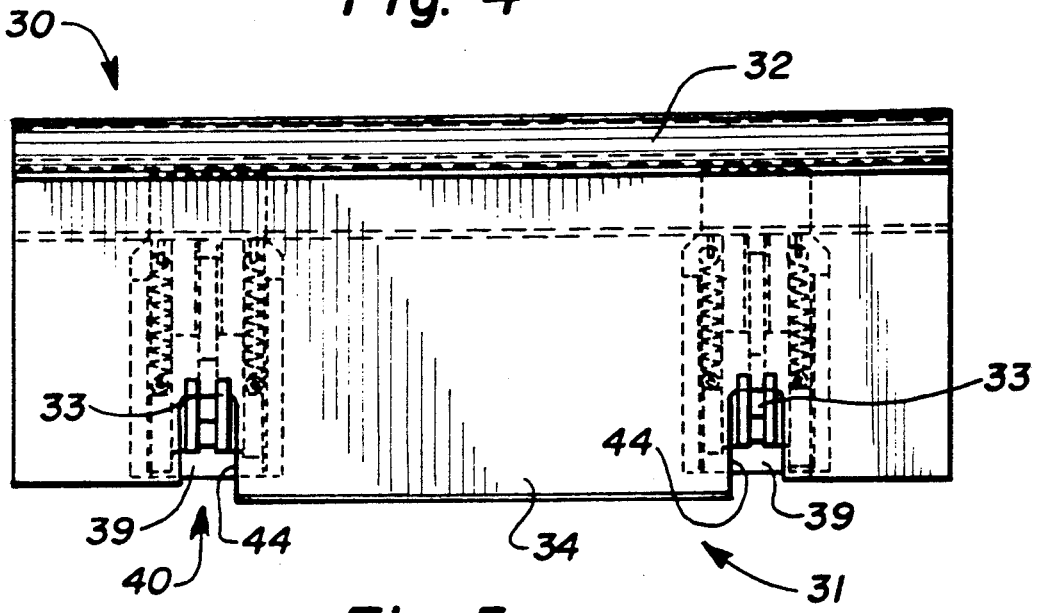
FIG. 4 is a rear elevational view of the adaptor mechanism corresponding to lines 4—4 of FIG. 3*a;*
Figure 5:
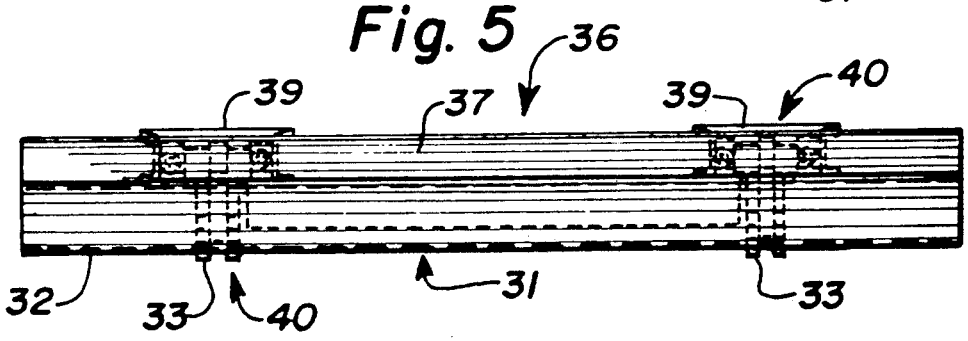
FIG. 5 is a top plan view of the adaptor mechanism shown in FIG. 4.
Figure 6:
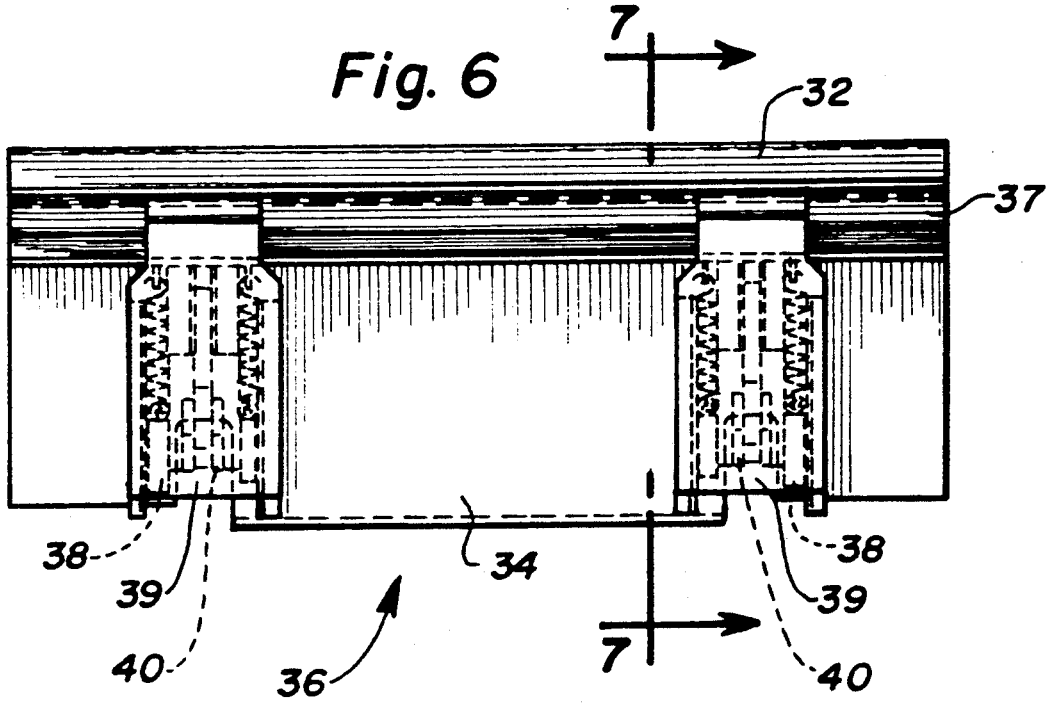
FIG. 6 is a front elevational view of the adaptor mechanism to be engaged with the implement.
Figure 11:
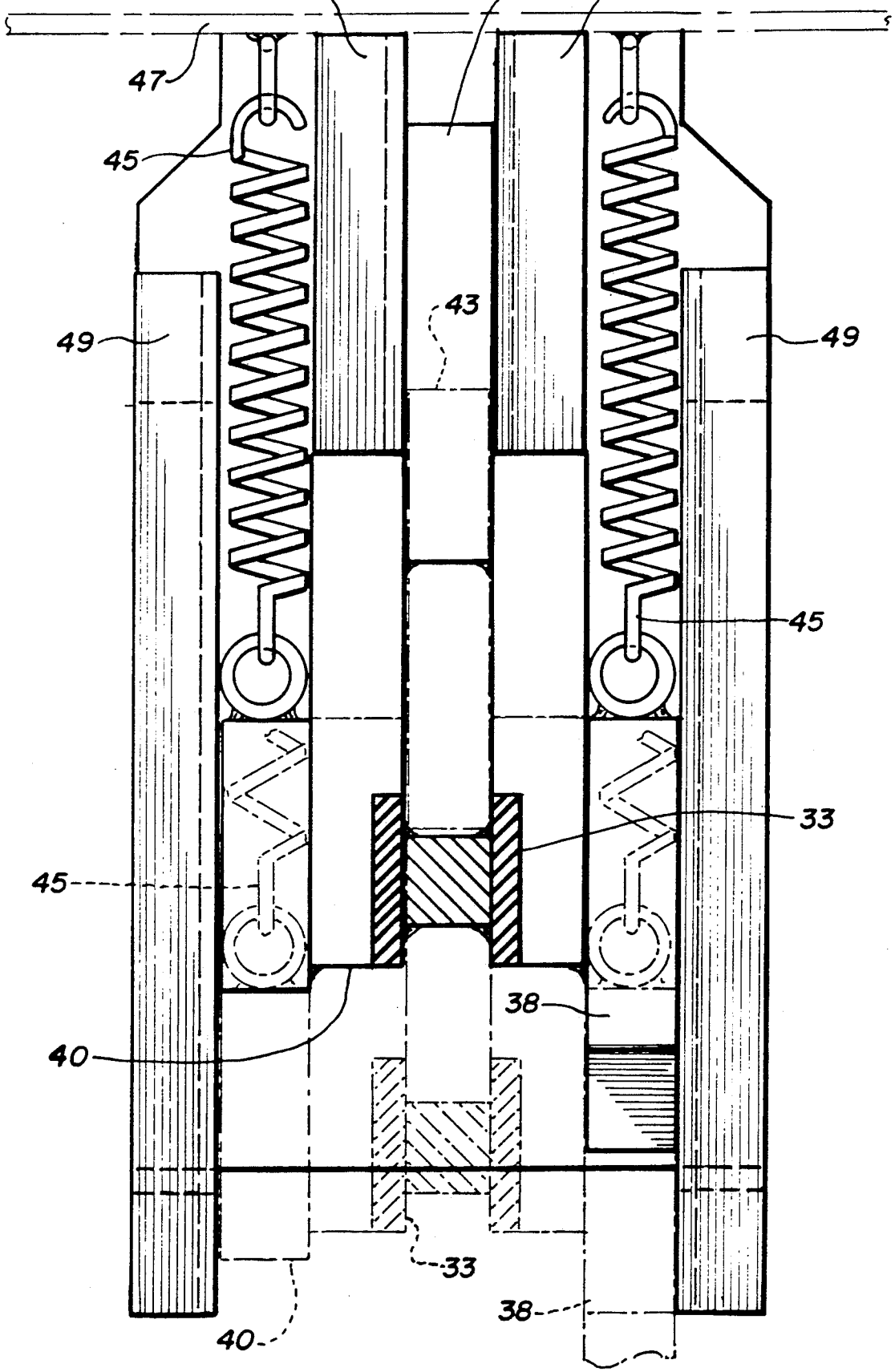
FIG. 11 is an enlarged partial cross sectional view of the adaptor mechanism taken along lines 11—11 of FIG. 10 to depict an elevational view of the movable locking mechanism, the movement of the locking mechanism being shown in phantom.

The structural details of the adaptor 30 are best seen in FIGS. 3 and 7–11. Each rearwardly extending hook member 33 is rigidly attached to the corresponding locking pin 38 to form a part of the locking mechanism 40 described in greater detail below. A pair of guide members 41 are affixed to the first faceplate 34 to guide the generally vertical movement of each locking mechanism 40 between the first and second faceplates 34, 39. As best seen in FIG. 11, the locking mechanism 40 is a specially formed piece having a locking pin 38 transversely offset from the hook member 33 to permit proper alignment between the implement mounting apparatus 15 and the hole 25 in the rearwardly extending bracket 24. The locking mechanism 40 also includes an upwardly extending guide portion 43 positionable between the guide members 41 to control the movement of the locking mechanism 40. As best seen in FIGS. 4 and 6, the first faceplate 34 is provided with a pair of vertically extending slotted cut-outs 44 to accommodate the vertical movement of the hook members 34 as will be described in greater detail below.

Returning now to FIGS. 3 and 7–11, it can be seen that the adaptor 30 is also provided with a pair of extension springs 45 extending between an upper mounting bracket 47 forming the upwardly sloped member 37 and the locking mechanism 40 to bias the locking mechanism 40 into an upward retracted position. To provide proper structural integrity of the second attachment mechanism 36, a pair of transversely spaced frame supports 49 are positioned on opposing sides of the springs 45 and affixed to both the first faceplate 34 and the corresponding faceplate 39 to encapsulate the generally vertically movable locking mechanism 40 and the biasing springs 45.

Figure 8:
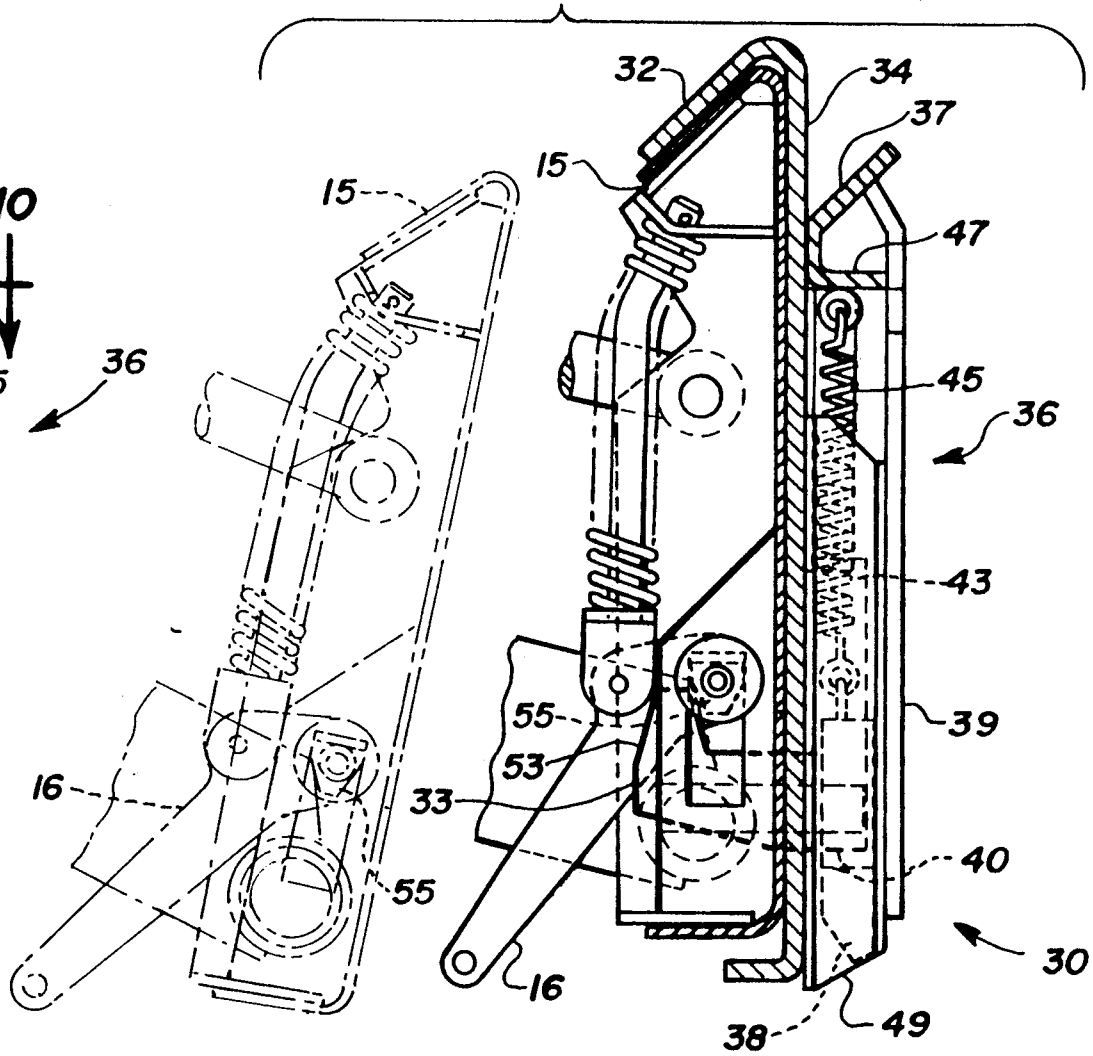
FIG. 8 is a cross-sectional view similar to that of FIG. 7 but showing the adaptor mechanism mounted on the implement mounting apparatus of the skid steer loader, the implement mounting apparatus also being shown in phantom as though moving into engagement with the adaptor mechanism.
Figure 7:
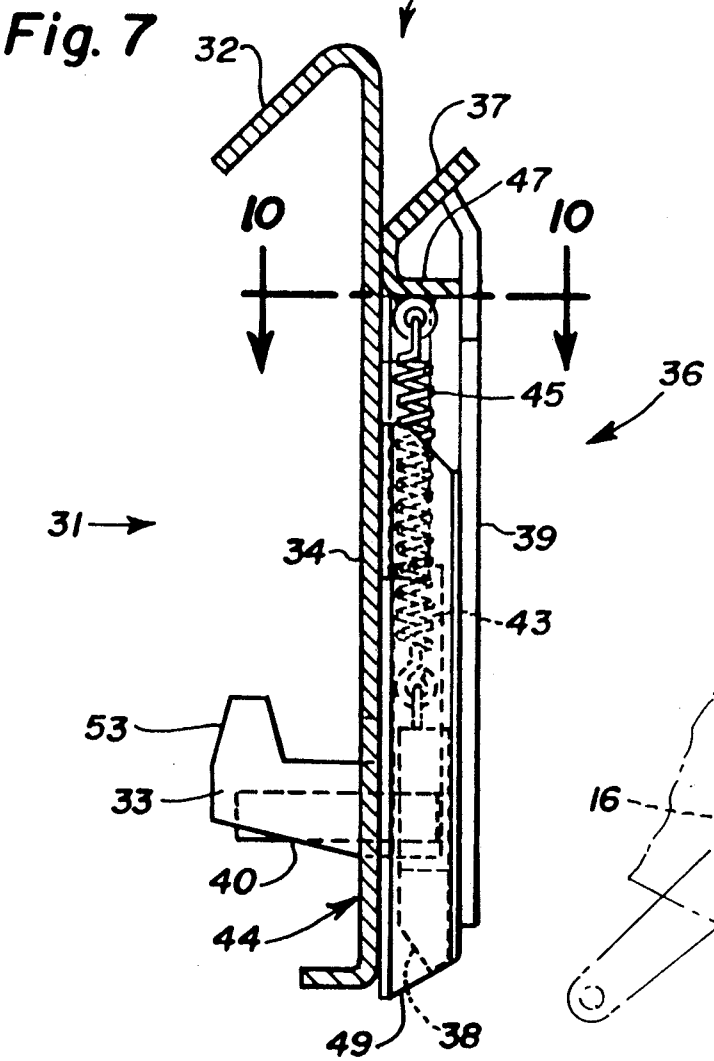
FIG. 7 is a cross-sectional view of the adaptor mechanism taken along lines 7—7 of FIG. 6.
Figure 9:
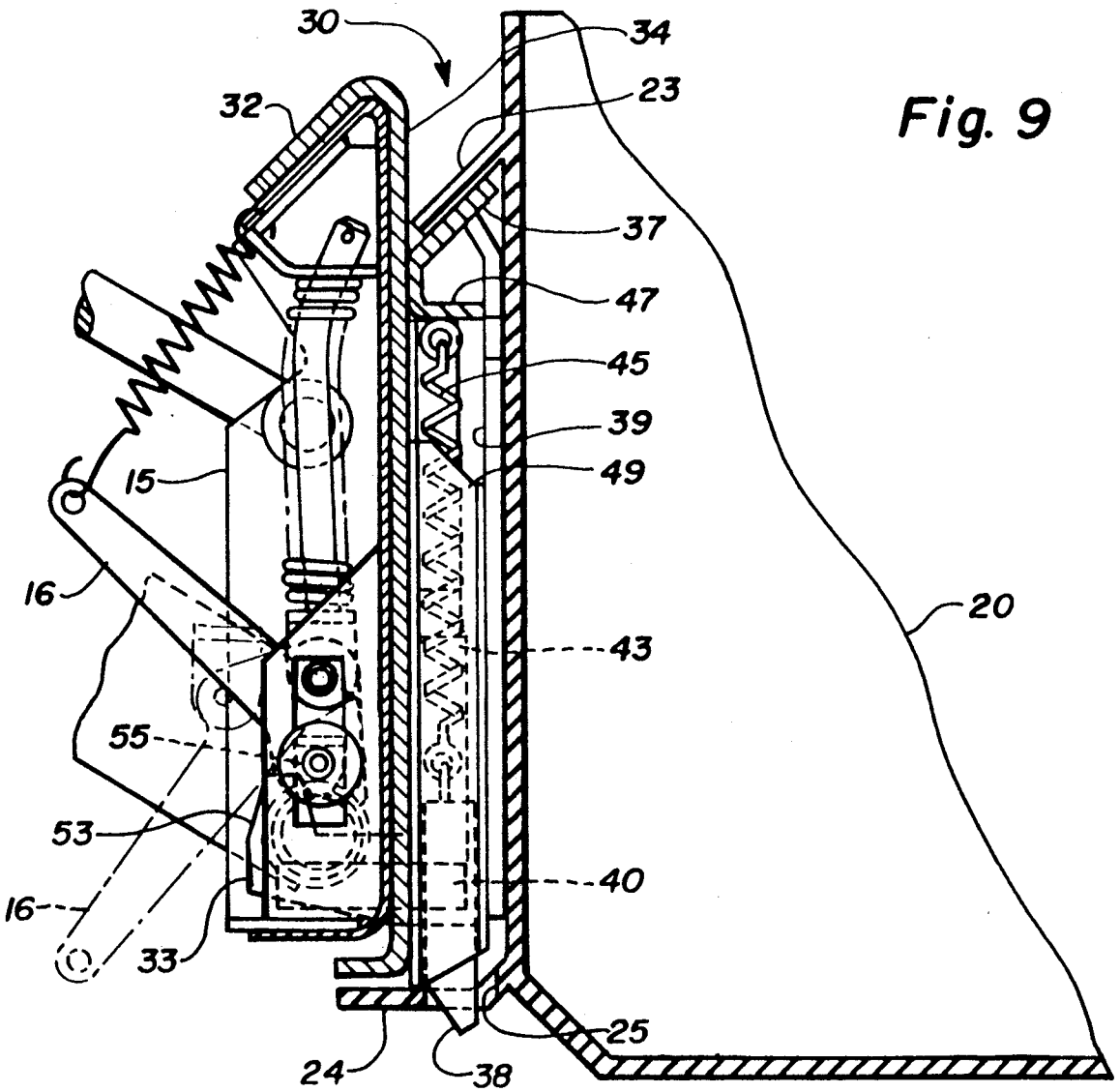
FIG. 9 is a cross sectional view similar to that of FIGS. 7 and 8 depicting an implement mounted on the adaptor mechanism, which in turn is mounted on the implement mounting apparatus of the skid steer loader, the movement of the overcenter wedging mechanism being shown in phantom.
Figure 10:
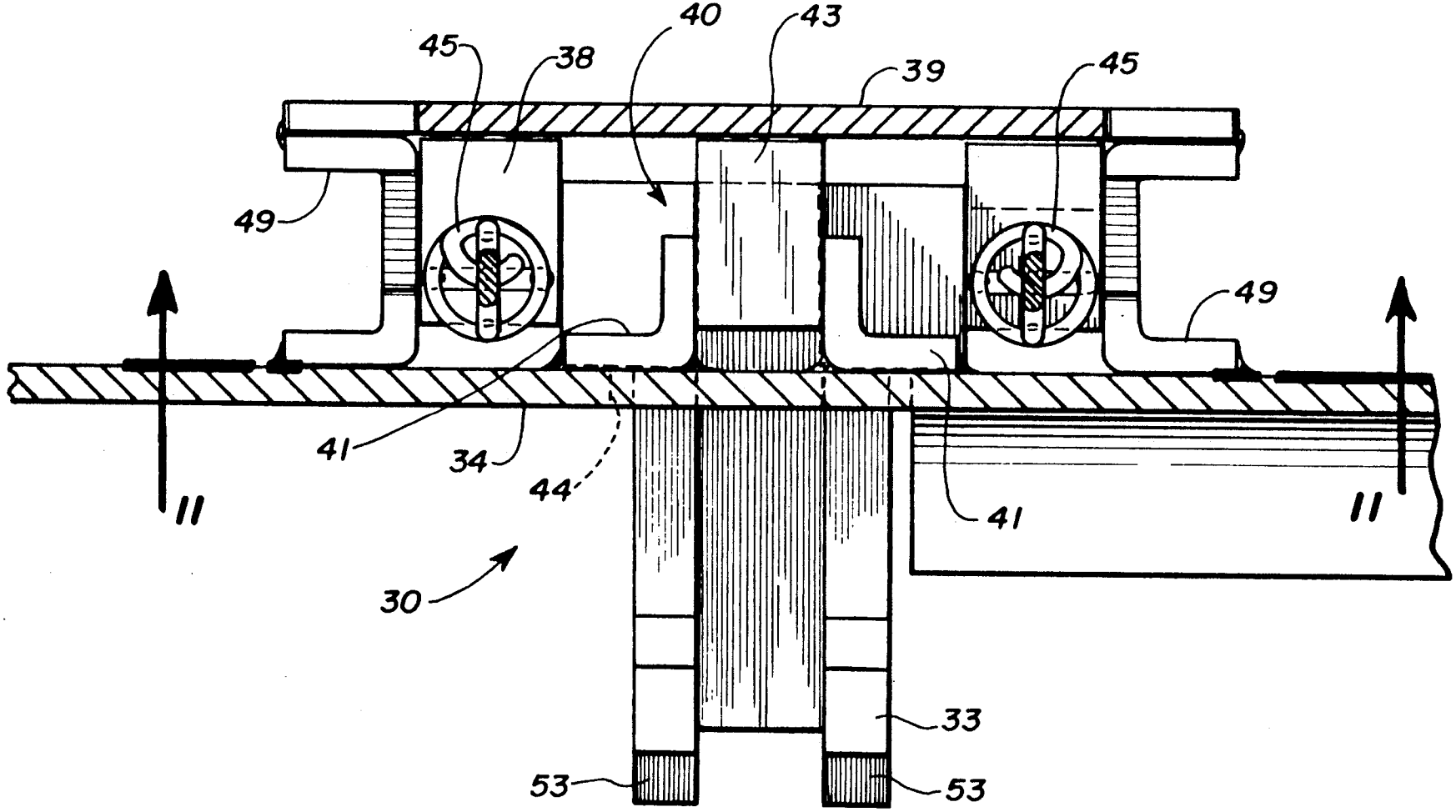
FIG. 10 is an enlarged partial cross sectional view of the adaptor mechanism taken along lines 10—10 of FIG. 7 to show a top plan view of the movable locking mechanism.

The operation of the adaptor 30 is best shown in FIGS. 7–9. FIG. 7 depicts the adaptor 30 in an unmounted state relative to both the loader 10 and the implement 20. The locking mechanism 40 is placed in the retracted position by the biasing force exerted thereon by the springs 45. In the retracted position, the locking pins 38 can be positioned above the corresponding holes 25 and the bracket 24 but are not engaged therewith. The hook members 33, when in the retracted position, are slightly out of alignment with the corresponding openings through the implement mounting apparatus 15, thereby requiring a slight downward movement of the locking mechanism 40 to permit the hook members 33 to pass into the implement mounting apparatus 15 for engagement with the overcenter wedging mechanism 16.

The adaptor 30 is first mounted on the implement mounting apparatus 15. The loader 10 is positioned, as shown in phantom in FIG. 8, such that the implement mounting apparatus 15 can be positioned underneath the angled support member 32. The hook members 33 are formed with a rearwardly facing cam surface 53 which is angled to cause a downward deflection of the hook members 33 when engaged against the implement mounting apparatus 15, thereby causing a sufficient downward movement of the locking mechanism 40 to align the hook members 33 with the openings in the implement mounting apparatus 15 to permit insertion thereof for a subsequent engagement with the overcenter wedging mechanism 16.

This slight downward movement of the locking mechanism 40 effects a corresponding extension of the springs 45 to increase the biasing force exerted thereby and urge the hook members 33 upwardly into engagement with the implement mounting apparatus 15. As a result, the spring 45 effectively clamps the adaptor 30 onto the implement mounting apparatus 15 between the angled support member 32 and the upwardly urged hook members 33 to retain the adaptor 30 on the implement mounting apparatus 15 without involvement of any additional fastening members. It should be noted that the locking pins 38 are oriented such that they are still positionable over the corresponding holes 25 in the rearwardly extending brackets 24 even when the adaptor 30 is mounted on the implement mounting apparatus 15.

As best seen in FIG. 9, the adaptor 30, having been mounted on the implement mounting apparatus 15, is now positionable upon proper manipulation of the loader 10 such that the upwardly sloped member 37 can be positioned underneath the angled member 23 on the implement 20. A subsequent positioning of the second faceplates 39 against the implement 20 positions the locking pins 38 above the holes 25 in the brackets 24 of the implement 20. A subsequent manipulation of the overcenter wedging mechanism 16 in the same manner described above with respect to FIGS. 1 and 2 forces the wedge 55 downwardly into an engaging position whereby the locking pins 38 are inserted into the holes 25, thereby mounting the implement 20 on the adaptor 30.

In this engaging position, the adaptor 30 is secured to the implement mounting apparatus 15 by the overcenter wedging mechanism 16 preventing the hook members 33 from withdrawing from the implement mounting apparatus 15, while the implement 20 is secured to the adaptor 30 by the locking pins 38 inserted through the holes 25 to prevent the implement 20 from pulling away from the adaptor 30. Although the springs 45 continue to exert a biasing force on the locking mechanism 40 to retract the locking mechanism from the engaging position, the biasing forces exerted by these springs 45 are overcome by the overcenter wedging mechanism 16 forcing the hook members 33 downwardly into the engaging position. Once the adaptor 30 is mounted on the implement mounting apparatus 15, a plurality of implements can be selectively mounted and dismounted in the same manner as if the implements had an identical attachment mechanism configuration as the loader 10. Accordingly, one skilled in the art will readily appreciate that the mounting of an implement 20 having an attachment mechanism 22 configured differently than the implement mounting apparatus 15 can be operatively mounted on the loader 10 by utilizing the identical overcenter wedging mechanism 16 in the same manner described relative to FIGS. 1 and 2.

Dismounting the implement 20 can be accomplished in the same manner as if the implement 20 utilized an attachment mechanism of a configuration identical to that of the loader 10. By releasing the overcenter wedging mechanism 16, the locking mechanism 40 is permitted to move back toward the retracted position by the biasing forces exerted by the springs 45. As a result, the locking pins 38 retract from the holes 25 in the rearwardly extending brackets 24 and permit the adaptor 30 to disengage from the implement 20. A subsequent reengagement of the same implement 20 or yet another implement having an identical attachment mechanism 22 can be accomplished by engaging the upwardly sloped member 37 with the corresponding angled member 23 and re-manipulating the overcenter wedging mechanism 62 to force the locking mechanism 40 back into its engaging position.

To permit the loader 10 to mount an implement 18 having correspondingly configured attachment mechanism, it is first necessary to remove the adaptor 30 from the implement mounting apparatus 15. Once the implement 20 has been dismounted from the adaptor 30 as depicted in FIG. 8, it is necessary to overcome the biasing force exerted by the springs 45 to deflect the hook members 33 downwardly sufficiently to pass through the openings in the implement mounting apparatus 15 so that the hook members 33 disengage from the implement mounting apparatus 15, permitting the locking mechanisms 40 to return to the fully retracted position whereupon the loader 10 can be manipulated to disengage the implement mounting apparatus 15 from the angled support member 32 to effect a disconnection of the adaptor 30 from the loader 10. Accordingly, it can be seen that the skid steer loader 10 can be utilized with implements 18, 20 manufactured in a configuration identical to the implement mounting apparatus 15 or manufactured in a completely different configuration, as exemplified by the attachment mechanism 22.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. An adapter mechanism for use with a loader having an implement mounting means configured in a first implement attachment configuration to permit the attachment of an implement configured in a different second implement attachment configuration, comprising:

a first attachment means configured in said first implement attachment configuration and being selectively movable for engagement with said implement mounting means; and a second attachment means configured in said second implement attachment configuration for engagement with said implement, said second attachment means being movable between a retracted position and an engaging position and being operably connected to said first attachment means and being operably associated therewith so that said first attachment means is movable with said second attachment means whereby manipulation of said first attachment means effects a corresponding movement of the second attachment means between said retracted and engaging positions to permit the mounting of said implement having said second implement attachment configuration on said implement mounting means having said first implement attachment configuration with said adapter mechanism disposed therebetween.

2. The adapter mechanism of claim 1 wherein said mounting means includes an overcenter wedging mechanism engageable with said first attachment means for detachably fixing said adapter mechanism to said mounting means.

3. The adapter mechanism of claim 2 wherein said second attachment means includes a locking mechanism movable between an engaging position and a retracted position, said first attachment means being movable in conjunction with the movement of said locking mechanism.

4. The adapter mechanism of claim 3 wherein said locking mechanism is biased by a spring toward said retracted position, the engagement of said overcenter wedging mechanism with said first attachment means forcing a movement of said locking mechanism from said retracted position toward said engaging position.

5. The adapter mechanism of claim 4 wherein said first attachment means includes hook members affixed to said locking mechanism and movable therewith, said hook members being insertable through corresponding openings in said mounting means for engagement with said overcenter wedging mechanism.

6. The adapter mechanism of claim 5 wherein said locking mechanism is generally vertically movable between fixed guide members and includes a locking pin positionable within a corresponding hole in said implement for detachably fixing said implement to said adapter mechanism.

7. The adapter mechanism of claim 6 wherein both said first and second attachment means including angled support members engageable with corresponding angled structural members on said mounting means and said implement, respectively, to effect a mounting of said adapter mechanism to both said mounting means and said implement.

8. The adapter mechanism of claim 6 wherein the insertion of said hook members into the openings in said mounting means forces a movement of said locking mechanism from said retracted position partially toward said engaging position so that the biasing force exerted by said spring assists in retaining said adapter mechanism on said mounting means until engagement of said hook members by said overcenter wedging mechanism.

9. An adapter mechanism for use with a loader having an implement mounting means, including a wedging mechanism, configured in a first implement attachment configuration to permit the attachment of an implement configured in a second implement attachment configuration, comprising:

a first attachment means configured in said first implement attachment configuration for engagement with said wedging mechanism for detachably fixing said adapter mechanism to said implement mounting means; and a second attachment means configured in said second implement attachment configuration for engagement with said implement, said second attachment means being movable between a retracted position and an engaging position and being operably connected to said first attachment means so that said first attachment means is movable with said second attachment means, the engagement of said wedging mechanism with said first attachment means causing a movement of said second attachment means to said engaging position for detachably fixing said implement to said adapter mechanism.

10. The adapter mechanism of claim 9 wherein said second attachment means includes a generally vertical locking member biased by a spring toward said retracted position.

11. The adapter mechanism of claim 10 wherein said fist attachment means includes hook members insertable through corresponding openings in said implement mounting means for selective engagement with said wedging mechanism.

12. The adapter mechanism of claim 11 wherein the insertion of said hook members into the openings in said implement mounting means forces a movement of said locking member from said retracted position partially toward said engaging position, the corresponding biasing force exerted by said spring urges said hook members against said implement mounting means to retain said adapter mechanism said implement mounting means.

13. The adapter mechanism of claim 12 wherein said locking member is generally vertically movable between fixed guide members and includes a locking pin positionable within a corresponding hole in said implement for detachably fixing said implement to said adapter mechanism.

14. The adapter mechanism of claim 13 wherein both id first and second attachment means including angled support members engageab1e with corresponding angled structural members on said mounting means and said implement, respectively, to effect a mounting of said adapter mechanism to both said mounting means and said implement.

15. The adapter mechanism of claim 14 wherein said wedging mechanism is movable between a locked position and an unlocked position and includes an overcenter spring to urge said wedging mechanism into each of said positions.

16. An adapter mechanism for use with a loader having an implement mounting means, including an overcenter wedging mechanism, configured in a first implement attachment configuration to permit the attachment of an implement configured in a second implement attachment configuration, comprising:

a first angled member engageable with corresponding angled structure on said implement mounting means;

a second angled member engageable with corresponding angled structure on said implement;

locking mechanism movable between a retracted position and an engaging position in which said locking mechanism engages said implement for detachably fixing said implement to said adapter mechanism; and hooking members fixed to said locking mechanism and movable therewith, said hooking members being engageable with said overcenter wedging mechanism for detachably fixing said adapter mechanism to said implement mounting means.

17. The adapter mechanism of claim 16 wherein the engagement of said overcenter wedging mechanism with said hooking members forces a movement of said locking mechanism into said engaging position.

18. The adapter mechanism of claim 17 wherein said hooking members are insertable through corresponding openings in said implement mounting means for selective engagement with said overcenter wedging mechanism, the insertion of said hooking members through said openings causing a movement of said locking mechanism from said retracted position partially toward said engaging position.

19. The adapter mechanism of claim 18 wherein said locking mechanism includes a spring biasing said locking mechanism toward said retracted position, said spring urging said hooking members into engagement with said implement mounting means to retain said adapter mechanism on said implement mounting means when said overcenter wedging mechanism is disengaged.

20. The adapter mechanism of claim 19 further comprising fixed guide members retaining said locking mechanism within a generally linear path of movement with respect thereto between said retracted position and said engaging position.

* * * * *